US005628332A

United States Patent [19]

Debourg et al.

[11] Patent Number: 5,628,332

[45] Date of Patent: May 13, 1997

[54] HAIR CARE DEVICE

[75] Inventors: Jean-Pierre Debourg, Lyons; Daniel Bontoux, Saint-Genis Laval, both of France

[73] Assignee: SEB S.A., Selongey, France

[21] Appl. No.: 496,911

[22] Filed: Jun. 29, 1995

[30] Foreign Application Priority Data

Jun. 30, 1994 [FR] France ..... 94 08578

[51] Int. Cl.[6] ..... A45D 24/10

[52] U.S. Cl. ..... 132/118; 132/162; 132/229; 132/243; 132/269

[58] Field of Search ..... 132/118, 143, 132/212, 162, 229, 243, 269

[56] References Cited

U.S. PATENT DOCUMENTS

| | | | |
|---|---|---|---|
| 2,474,106 | 6/1949 | Jackson et al. . | |
| 4,766,291 | 8/1988 | Collins | 132/118 |
| 4,807,652 | 2/1989 | Bachrach | 132/137 |
| 5,072,746 | 12/1991 | Kantor | 132/219 |
| 5,261,427 | 11/1993 | Dolev . | |
| 5,353,817 | 10/1994 | Kantor et al. | 132/118 |

FOREIGN PATENT DOCUMENTS

| | | |
|---|---|---|
| 1249338 | 11/1960 | France . |
| 158666 | 11/1932 | Germany . |
| WO9115134 | 10/1991 | WIPO . |

*Primary Examiner*—Gene Mancene
*Assistant Examiner*—Pedro Philogene
*Attorney, Agent, or Firm*—Loeb & Loeb LLP

[57] ABSTRACT

A device and method for destroying parasites present in a mass of hair or fur growing from a skin surface, the device being composed of a handling body adapted to be gripped by a user; a comb fixed to the body and composed of a plurality of teeth, the teeth having portions adapted to be displaced through the mass of hair or fur when the device is in use; and a source of energy for at least locally raising the temperature of the hair or fur when the teeth are displaced through the mass of hair or fur, wherein at least part of the portions of the teeth are thermally conductive and are operatively associated with a source of energy for supplying sufficient heat energy to destroy parasites on the hair or fur which is in contact with the portions.

22 Claims, 3 Drawing Sheets

HAIR CARE DEVICE

BACKGROUND OF THE INVENTION

The present invention relates to the field of apparatus, or devices, for the care, or maintenance, of hair, particularly hair on the head, or fur.

The invention concerns particularly a device for dealing with parasites, such as lice and nits, which become lodged in the hair. The eradication of other parasites which become lodged in hair, including human hair and the fur of animals, is also possible with a device according to the present invention.

It is already known in the prior art to provide delousing apparatus of the type represented by electric combs or brushes which function with the aid of electrical discharges. Such apparatus does not permit, however, the destruction of nits fixed on the hairs. In effect, nits are surrounded by an isolating envelope through which an electric current can not pass. Such apparatus thus presents a major shortcoming in that it is necessary to use the delousing apparatus for the treatment of hair during at least one reproduction cycle of the lice, which is around one month, in order to be effective.

There also exist delousing apparatus which act by projecting steam or hot air in proximity to the roots of the hair. The shortcoming of such apparatus resides in the fact that the projecting force, or power, and the temperatures employed are insufficient to be effective.

SUMMARY OF THE INVENTION

An object of the invention is to provide a device for destroying parasites, and particularly lice and nits, which become fixed, or lodged, in hair or fur, by locally supplying heat energy.

Another object of the invention is to provide a device comprising means which are brought to a temperature sufficient to destroy parasites lodged in or on hair or fur without utilizing either electric discharges or a projection of vapor or hot air.

A supplemental object of the invention is to provide a simple and inexpensive device in the form of a comb permitting, on the one hand, destruction of parasites which have become lodged in or on the hair and, on the other hand, performance of very simple maintenance operations on the hair.

The objects of the invention are achieved with the aid of a device for eradicating parasites from hair or fur, the device comprising a handling body on which is fixed a comb provided with teeth and means for destroying the parasites, permitting to at least locally increase the temperature of the hair when the teeth of the comb are displaced through the hair or fur, characterized in that the teeth of the comb, which are adapted to penetrate into a mass of hair or fur, have at least one thermally conductive portion associated with means generating the heat energy necessary to destroy the parasites when the latter enter into direct contact with the teeth of the comb.

The objects of the invention are equally achieved by the performance of a process for eradicating parasites which become lodged in hair or fur, consisting in utilizing a comb and displacing the teeth of the comb through the hair or fur, characterized in that it comprises: using the teeth of the comb to furnish heat energy at least locally to the hair or fur; and placing the parasites in direct contact with the heating teeth of the comb.

The characteristics and advantages of the present invention will become more readily apparent from a reading of the following description presented with reference to the drawing.

In the following description, references to hair are intended to also encompass fur.

DESCRIPTION OF THE PREFERRED EMBODIMENTS

Figure 1:
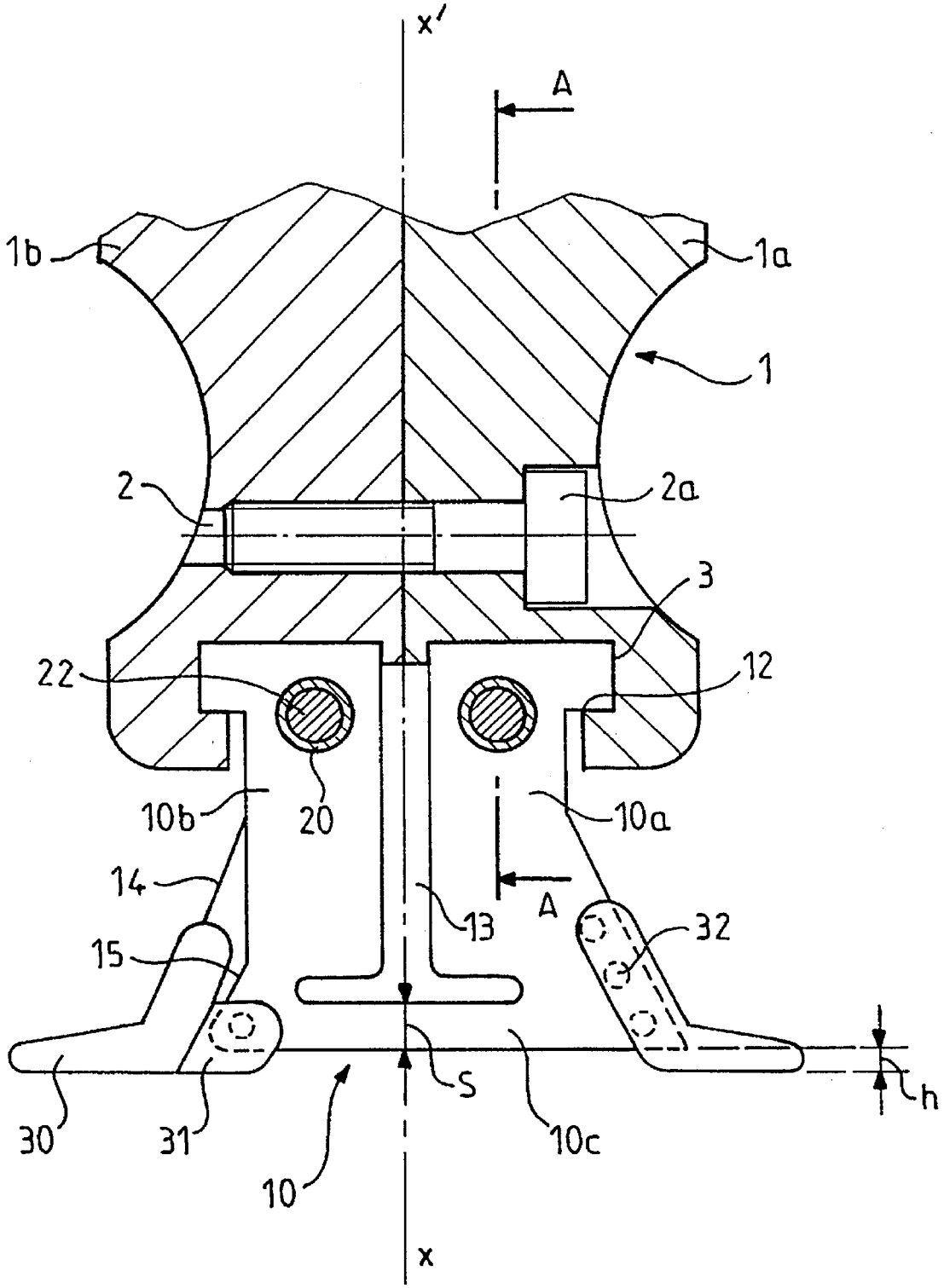
FIG. 1 is a cross-sectional view of a first preferred embodiment of a device according to the invention.

FIG. 1 is a cross-sectional view of a preferred embodiment of a device according to the invention. This embodiment relates in particular to personal hygiene apparatus used to eliminate parasites such as lice and nits in the hair.

The device according to the invention includes a handling, or manipulation, body 1 composed of a first part 1*a* and a second part 1*b*. These parts are assembled together through the intermediary of one or more bores 2 formed through parts 1*a* and 1*b* and by an assembly means in the form of a screw 2*a* in each bore 2, or any other known means for rigidly securing two parts together.

Figure 2:
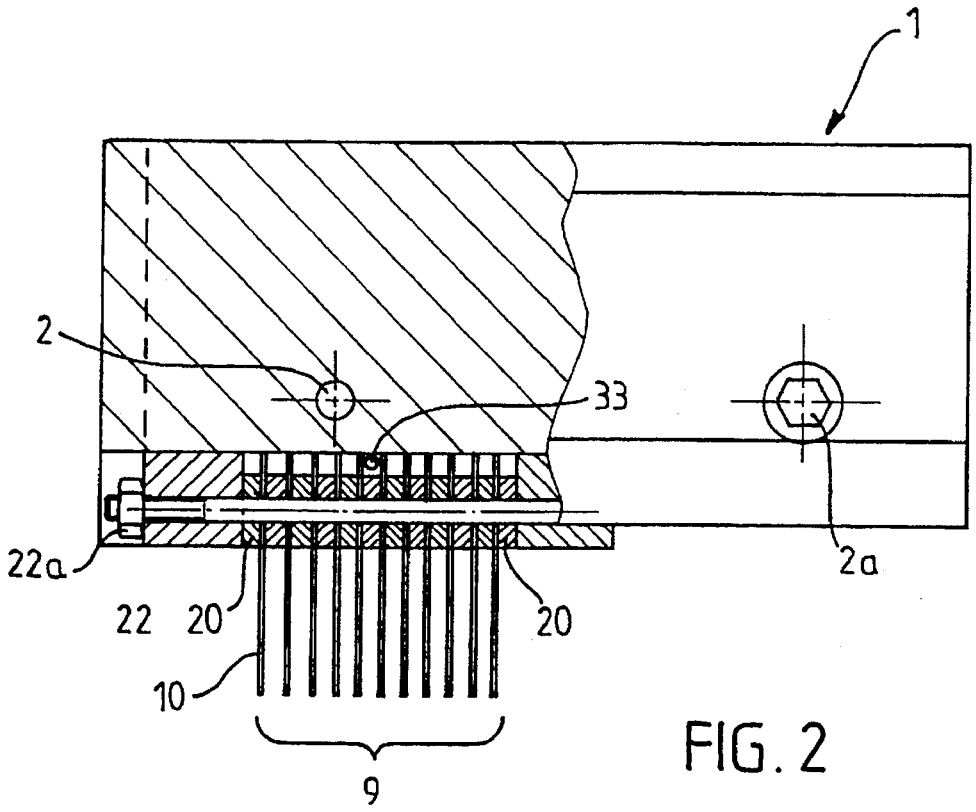
FIG. 2 is a partial cross-sectional view of the device of FIG. 1, taken along the plane A—A of FIG. 1.

Body 1 constitutes thus a gripping member for the device according to the invention. Body 1 has a specific configuration in its lower part which is intended to maintain an assembly of teeth forming a comb 9 (FIG. 2).

The device according to the invention includes a heat source permitting the temperature of the teeth to be raised in a manner to heat the hair which comes in contact with the teeth to a temperature above 60° C. Attainment of such a temperature is indispensable for degrading the proteins of living beings or parasites which may be fixed in the hair.

According to a preferred embodiment of a device according to the invention, the teeth are spaced from the base surface from which the hair grows, such as the scalp or other skin area of a person, by a distance of at least several tenths of a millimeter, shown in FIG. 1, by the intermediary of heels 30, 31 which are of a thermally isolating material and are fixed at least to the extremity of at least certain teeth in order to prevent direct contact between the base surface of the hair system and the thermally conductive portions of the teeth. Heels 30 and 31 thus permit avoidance of burning sensations on the part of the user of the device during treatment of the hair. The thermally conductive portions of the teeth of comb 9 are inserted in a metallic support which is in thermal communication with the heat energy source. Advantageously, the metallic support is a metal bar having slots or recesses into which the extremities of thermally conductive portions of the teeth are introduced.

After a crimping operation, the teeth are intimately connected with the metallic bar. The metallic bar is in contact with the heat source constituted by at least one heating element of the type having a positive temperature coefficient of resistance for example supplied by an electric current source.

Thermal regulation is assured by a thermal probe, for example a resistance element having a negative temperature coefficient of resistance associated with electronic monitoring and control means.

Figure 3:
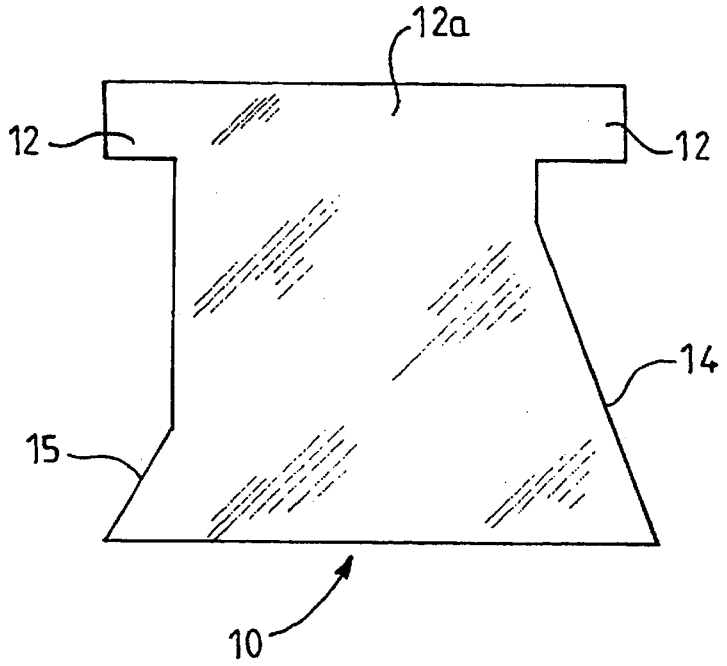
FIG. 3 is a pictorial view of an embodiment of one component which will be shaped for use in the device according to the invention.

The teeth are formed in a known manner and preferably have the form of metallic blades 10. An example of a blank for one such blade is shown in FIG. 3. Blades 10 are inserted in the metallic support (not shown) via the upper part 12*a* of blades 10. Blades 10 are thus heated by thermal conduction.

The metallic support is fixed, by any known means, on body 1. The material constituting blades 10 is for example brass hammer-hardened in the preferred embodiment according to the invention, to present a good mechanical strength, or stainless steel.

In further accordance with the invention, blades 10 have a specific form such as shown in FIG. 1. Thus, to form blade 10, the blank of FIG. 2 is cut to have two through bores and a gap, or slot, 13, the purpose of which will be described below.

Each of the blades 10 has, at one side and the other a shoulder 12 each of which is inserted into a groove 3 formed in body 1 and more particularly in the first part 1*a* and the second part 1*b*. When these parts are assembled together they maintain the assembly of blades 10 in place. The arrangement thus constituted is in the form of the comb 9 whose teeth are constituted by blades 10. Blades 10 are assembled together through the intermediary of shanks 22 which pass through the through bores in all of blades 10. Advantageously, each shank 22 is threaded at each end to receive a respective nut 22*a*, one of which is visible in FIG. 2. The resulting teeth thus have substantially the form of a U with two vertical arms 10*a* and 10*b* fixed at their upper ends in body 1, and a horizontal base 10*c* connecting the vertical arms 10*a*, 10*b* in a manner to position the horizontal base 10*c* relative to the skin surface from which the hair grows when comb 9 is displaced through the hair.

Advantageously, each of the vertical arms 10*a* and 10*b* is traversed by a respective shank 22. Vertical arms 10*a* and 10*b* are located in the same plane for example, and are separated by gap 13.

Comb 9 is thus constituted by an assemblage of teeth in the form of metal blades 10.

Advantageously, two adjacent blades are spaced apart by washers 20 also mounted on shanks 22 in a manner to establish the desired spacing between blades 10.

Successive blades 10 as thus assembled are preferably spaced apart by a distance not greater than 2 mm. Such a spacing is advantageous particularly for the treatment and care of hair and in particular for removing attached parasites from the hair. In addition, such a separation not greater than 2 mm essentially assures that parasites will come in contact with at least one of the blades 10 forming comb 9 when the parasites are in a part of the hair which is traversed by comb 9. The parasites are thus killed by means of a substantial heating.

The thickness of blades 10 is of the order of 0.4 mm and their width, in the horizontal direction of FIG. 3, is preferably between 15 and 20 mm, this including vertical arms 10*a* and 10*b* and gap 13. Such dimensions are advantageous for obtaining a sufficient heat capacity to permit heating of the hair to a temperature above 60° C. when blades 10 pass through the hair. The free height of blades 10, and more particularly of vertical arms 10*a*, 10*b* extending for example along the axis x-x' of FIG. 1, is between 15 and 20 mm. Such a free height is preferably that which is outside of body 1, permitting blades 10 to reach the scalp, in proximity to which nits come to lodge.

Preferably, heels 30, 31 are fixed to the extremities of the horizontal bases 10*c* of blades 10 for example by means of rivets 32 as shown in FIG. 1. According to a modification of the preferred embodiment of the invention, heels 30 and 31 are overmolded onto the extremities of horizontal bases 10*c* and are made of a plastic material capable of withstanding high temperatures. Heels 30 and 31 can equally, according to another version of the device according to the invention, extend along the entire part of each horizontal base 10*c* which faces the base surface of the hair, e.g. the scalp, in a manner to prevent direct contact between horizontal bases 10*c* and the base surface of the hair or more precisely the skin of the user, while only slightly covering blades 10 in order to not prevent contact between parasites and blades 10.

In addition, comb 9 is constituted by an assembly of successive blades, the assembly permitting the hair to be attacked with blades 10 alternately in forward and reverse movements in order to enable blades 10 to be introduced more easily into the hair. Such a configuration is obtained for example by a more or less substantial flaring of successive blades 10 and by heels 30 and 31 having different sizes. Larger heels 30 have a bent form with a horizontal portion coming in contact with the scalp, while the smaller heels 31 fixed by any means to an adjacent blade 10 have the form of a parallelepiped and are inset from the larger heels 30. The smaller heels 31 also come to bear against the scalp of the user. Successive blades 10 present alternatively a large flaring 14 and a smaller flaring 15 in a manner to accentuate the ease of penetration of the resulting comb 9 into a mass of hair.

According to a preferred embodiment of the device according to the invention, blades 10 have an asymmetric configuration with a large flaring 14 on one of the vertical arms 10*a* and a smaller flaring 15 on the other vertical branch 10*b*. The assembly of asymmetric blades 10 is thus done in an alternating manner, with the large flaring 14 of one blade 10 facing to the right in FIG. 1, and the large flaring 14 of the next succeeding blade 10 facing to the left in FIG. 1, thereby providing a comb 9 presenting two attack fronts. Thus, along each edge of comb 9, larger flarings 14 and larger heels 30 alternate with smaller flarings 15 and smaller heels 31. Entry of comb 9 into a mass of hair is thus made progressive by the presence of a succession of blades 10 which project forward in alternation with blades 10 that are set back.

Advantageously, the large heels 30 and the small heels 31 are overmolded at the locations of acute angles formed between vertical arms 10*a*, 10*b* and horizontal bases 10*c*.

According to another embodiment of the device according to the invention, blades 10 themselves are utilized as the heat source. For this purpose, a current can be caused to flow through each blade 10 in order to heat the blade. For example, all of blades 10 can be connected together electrically in series and can be formed to have a resistance such that they will conduct a current of the order of 8 A at a voltage of the order of 3 V for example. The connection of successive blades 10 in series is effected by selection of the material of washers 20 and by shaping washers 20 so that they are interposed between blades 10 and shanks 22. Specifically, along each shank 22, washers 20 are alternatingly electrically isolating and electrically conductive, thereby creating a series current flow path from one blade to another. For example, in each blade 10, current may pass in order through vertical branch 10*a*, horizontal base 10c and vertical branch 10*b*, and will then pass through a conductive washer 20 to the next succeeding blade. Thus, the gap 13 in each blade 10 helps to establish a defined current path through each blade. Blades 10 are held in grooves 3 in a position such that they do not contact shanks 22, or shanks 22 are made of or covered with, an electrical insulating material. The current would then pass through the next succeeding blade 10, in the opposite direction. If the position of the succeeding blade is reversed with respect to that of the first-mentioned blade, in the manner illustrated in FIG. 1, the flow of current in the opposite direction through the succeeding blade would again be through vertical branch 10*b*, horizontal base 10*c* and vertical branch 10*a*. The presence of electrically isolating washers 20 alternating with electrically conductive washers 20 permits the creation of a current flow path which traverses the assembly of blades 10 so that they are electrically connected in series. Each vertical branch 10*b* or 10*a* is separated from the branch 10*b* or 10*a* of the adjacent blade alternately by an electrically isolating washer 20 and an electrically conductive washer 20.

Advantageously, horizontal base 10*c* has a transverse cross section which is smaller than that of the vertical arms 10*a*, 10*b* so as to constitute a higher temperature zone of blades 10 when an electric current flows through blades 10. In effect, it is the horizontal bases 10*c* which come into proximity to the scalp as comb 9, constituted by blades 10, is introduced into a mass of hair. The small cross section of horizontal base 10*c* permits heating to be produced by a significant Joule effect. Blades 10 can thus themselves form heating means without requiring a separate or distinct heating element.

The cross section of horizontal base 10*c* of each blade 10 preferably has an area of between 10 and 30 $mm^2$, and more preferably of the order of 30 $mm^2$.

Preferably, the assembly of blades 10 is associated with a heat sensor 33 disposed adjacent the upper portion of the assembly and preferably above shanks 22 and adjacent body 1. Appropriate dimensioning of blades 10, easily determined by experimentation, thus permits the creation of a comb 9 constituted by teeth in the form of blades 10 such that the hottest parts of blades 10, in this case horizontal bases 10*c*, reach a temperature lower than 140° C. Such a temperature limit is essential to avoid damaging hair or fur and remains quite sufficient for destroying parasites. In addition, the hottest zones of blades 10 are brought to a relatively high temperature approaching 140° C., which allows a substantial temperature drop during passage of the device according to the invention through the hair while preventing the temperature of the blades 10 which come in contact with the hair from falling below 60° C.

The good heat delivery by the blades 10, associated with their high temperature of the order of 140° C., permits blades 10 and the hair in contact with blades 10 to be maintained at a temperature above 60° C., even in the presence of thermal variations due to the transmission of heat to the hair.

Temperature sensor 33 is preferably constituted by an electronic thermostat and acts to compensate for the loss of heat by controlling the electric current flowing in the teeth, and more particularly in blades 10 of comb 9. Loss of heat in blades 10 is essentially due to the displacement of blades 10 through the hair, which is generally at room temperature. The electronic thermostat comprises for example a temperature sensor of the type having a negative temperature coefficient of resistance associated with known electronic circuitry which is not shown.

According to another embodiment of the invention, such electronic circuitry is associated with conventional heating means of the type composed of electrical heating resistances or sheathed heating resistances which permit teeth or blades 10 to be heated solely by thermal conduction. Optimal operating temperatures can also be achieved by utilizing heating elements having an output power adapted to the size and configuration of the teeth utilized.

A device according to the invention thus allows eradication of parasites which have come to lodge in or on the hair by the intermediary of a process consisting in utilizing comb 9, displacing the teeth of comb 9 through the hair and utilizing the teeth of comb 9 to deliver heat energy at least locally to the hair.

The process according to the invention also consists in supplying thermal energy to a mass of hair in order to heat the hair at least locally to a temperature above 60° C.

In addition, the process includes heating at least a portion of the teeth of comb 9 by Joule effect.

The operation of a device according to the invention is the following. After the temperature of blades 10 has become stabilized, the user grips the apparatus via body 1 and introduces comb 9 into a mass of hair with the aid of heels 30, 31.

The user then exerts a force on the device in a manner to bring heels 30, 31 into contact with the scalp or skin surface. Displacement of comb 9 constituted by the assembly of blades 10 permits attainment, at least locally, of a temperature higher than 60° C. Thus, all parasites lodged in the hair at the base of the hair mass are destroyed as a result of coming into direct contact with the teeth of comb 9. The means for destroying parasites thus comprise comb 9 in association with a heat source.

Figure 4:
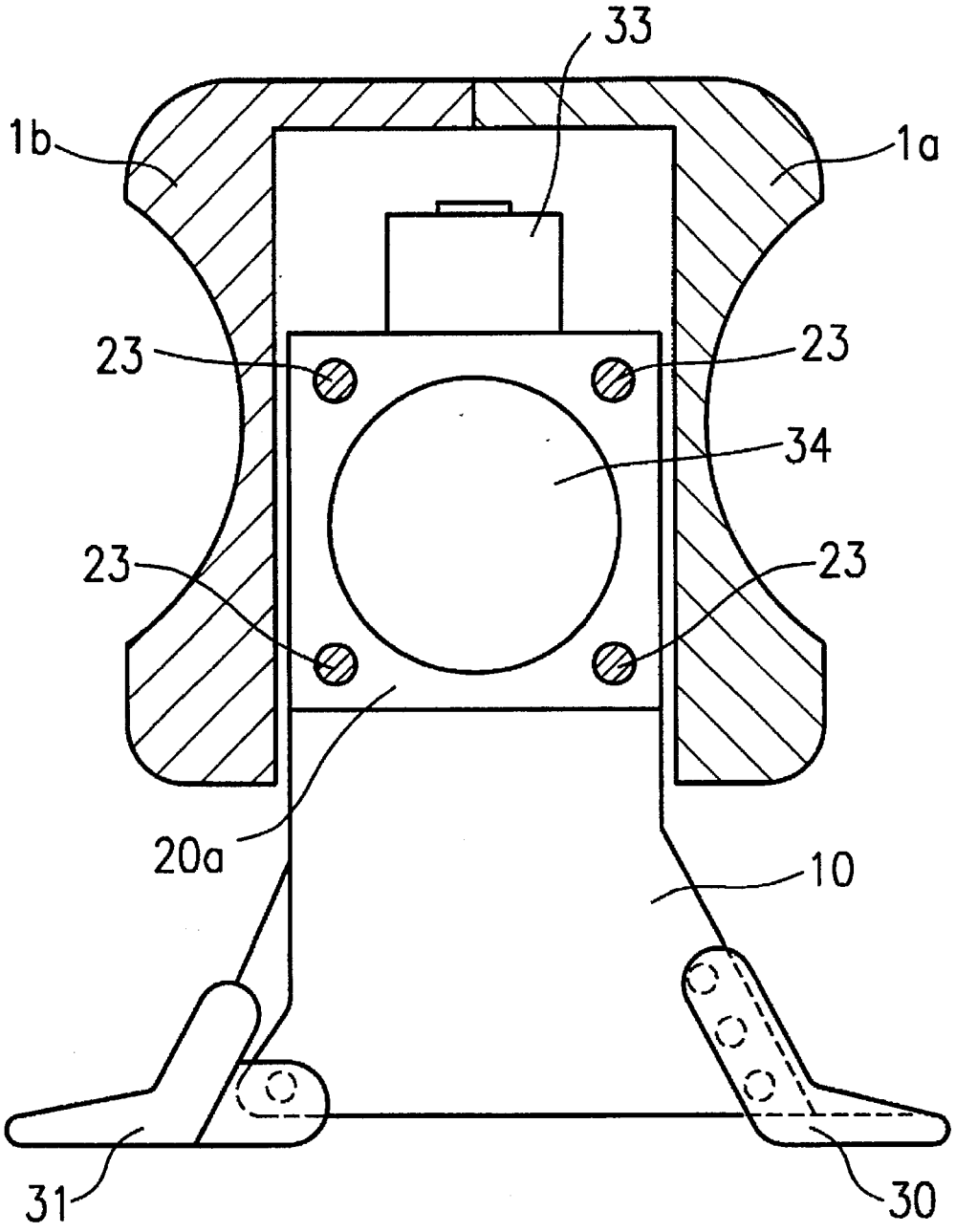
FIG. 4 is a view similar to that of FIG. 1 showing a second preferred embodiment of a device according to the invention.

A second preferred embodiment of the invention is shown in a cross-sectional view in FIG. 4. This embodiment includes an assembly of blades 10 and metal spacer members 20*a*. In the assembly, blades 10 alternate with spacer members 20*a* Spacer members 20*a* replace the washers employed in the previously disclosed embodiment of the invention. Spacer members 20*a* and blades 10 are each provided with a through hole 34 having the same diameter in all parts in order to create, at the interior of the resulting assembly, an internal cylindrical volume in which there can be housed a ceramic support and heating wires, rods, or bars constituting a heat source for the device. Any other heating medium can be arranged at the interior of this assembly without departing from the framework of the present invention. Metal members 20*a* all have a substantially rectangular form and are fixed together with blades 10 to body parts 1*a* and 1*b* by means of four tie-rods 23 located around openings 34 and traversing the assembly of blades 10 and members 20*a*. Metal members 20*a* bear against, and are thus intimately associated with, the upper ends of blades 10 to thus provide a metallic support which promotes efficient transfer of heat from the heat source toward blades 10. Tie-rods 23 are advantageously fixed at their ends to body parts 1*a* and 1*b*.

This application relates to subject matter disclosed in French Application number 9408578, filed on Jun. 30, 1994, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. Device for destroying parasites present in a mass of hair or fur growing from a skin surface, said device comprising:

a handling body adapted to be gripped by a user; a comb fixed to said body and composed of a plurality of teeth, said teeth having portions adapted to be displaced through the mass of hair or fur when said device is in use; and energy supply means for at least locally raising the temperature of the hair or fur when the teeth are displaced through the mass of hair or fur, wherein at least part of said portions of said teeth are thermally conductive and are operatively associated with said energy supply means for supplying sufficient heat energy to destroy parasites on the hair or fur which is in contact with said portions.

2. Device according to claim 1 wherein said energy supply means are operative to raise the temperature of said teeth in a manner to heat hair or fur which is in contact with said portion to a temperature above 60° C.

3. Device according to claim 2 wherein said teeth have outer extremities which are remote from said handling body, and further comprising a plurality of heel members made of a thermally insulating material and fixed to the outer extremities of at least some of said teeth, said heel members being configured and positioned to maintain the thermally conductive part of said portions of said teeth spaced from the skin surface by a distance of at least several tenths of a millimeter when said portions of said teeth are displaced through the mass of hair or fur.

4. A device as defined in claim 3 wherein the thermally conductive part of said portions of said teeth are set into a metallic support which is in thermal communication with said energy supply means.

5. A device as defined in claim 3 wherein each of said teeth has substantially a U-shaped form composed of two vertical arms having upper ends fixed to said handling body, and a horizontal base connecting together said vertical arms, said horizontal base being disposed to face the skin surface when said portions of said teeth are displaced through the mass of hair or fur.

6. A device as defined in claim 5 wherein said horizontal base of each of said teeth has two opposed ends, and each of said heel members is fixed at a respective opposed end of a respective horizontal base.

7. A device as defined in claim 5 wherein each of said teeth is constituted by a flat metal blade.

8. A device as defined in claim 7 wherein said comb has on outer extremity remote from said handling body, said outer extremity has two opposed edges, said plurality of teeth are composed of a first set of teeth and a second set of teeth, the teeth of said first set alternating with the teeth of said second set, and, along at least one of the opposed edges, the teeth of said first set projects beyond the teeth of said second set to provide an edge which facilitates entry of said teeth into the mass of hair or fur.

9. A device according to claim 8 wherein successive ones of said teeth are spaced apart by a distance of less than 2 mm.

10. A device as defined in claim 9 wherein said horizontal base of each of said teeth has two opposed ends, and each of said heel members is fixed at a respective opposed end of a respective horizontal base.

11. A device as defined in claim 10 wherein said teeth are connected to conduct an electric current which effects heating of said teeth, whereby said teeth constitute at least part of said energy supply means.

12. A device as defined in claim 11 wherein said horizontal base of each of said teeth has a transverse cross section, each of said vertical arms has a transverse cross section, and the transverse cross section of said horizontal base has an area smaller than that of the transverse cross section of each of said vertical arms, whereby said horizontal base of each of said blades constitutes the hottest region of the respective one of said blades when an electric current flows through said blades.

13. Device according to claim 1 wherein said teeth have outer extremities which are remote from said handling body, and further comprising a plurality of heel members made of a thermally insulating material and fixed to the outer extremities of at least some of said teeth, said heel members being configured and positioned to maintain the thermally conductive part of said portions of said teeth spaced from the skin surface by a distance of at least several tenths of a millimeter when said portions of said teeth are displaced through the mass of hair or fur.

14. A device as defined in claim 1 wherein each of said teeth has substantially a U-shaped form composed of two vertical arms having upper ends fixed to said handling body, and a horizontal base connecting together said vertical arms, said horizontal base being disposed to face the skin surface when said portions of said teeth are displaced through the mass of hair or fur.

15. A device as defined in claim 1 wherein each of said teeth is constituted by a flat metal blade.

16. A device as defined in claim 1 wherein the thermally conductive part of said portions of said teeth are set into a metallic support which is in thermal communication with said energy supply means.

17. Delousing apparatus comprising a device for destroying lice and nits present in a mass of hair or fur growing from a skin surface, said device comprising: a handling body adapted to be gripped by a user; a comb fixed to said body and composed of a plurality of teeth, said teeth having portions adapted to be displaced through the mass of hair or fur when said device is in use; and energy supply means for at least locally raising the temperature of the hair or fur when the teeth are displaced through the mass of hair or fur, wherein at least part of said portions of said teeth are thermally conductive and are operatively associated with said energy supply means for supplying sufficient heat energy to destroy lice and nits on the hair or fur which is in contact with said portions.

18. A process for destroying parasites present in a mass of hair or fur, said process comprising: providing a comb having a plurality of teeth; displacing the teeth through the mass of hair or fur; delivering heat energy from the teeth to the mass of hair or fur; and bringing parasites on the hair or fur into contact with the teeth.

19. A process as defined in claim 18 wherein said step of delivering heat energy is performed in a manner to heat the hair or fur at least locally to a temperature above 60° C.

20. A process as defined in claim 19 wherein said step of delivering heat energy comprises heating at least a portion of the teeth by Joule effect.

21. A process as defined in claim 18 wherein said step of delivering heat energy comprises heating at least a portion of the teeth by Joule effect.

22. A process as defined in claim 18 wherein said step of delivering heat energy comprises causing heat energy to flow along the teeth by thermal conduction.

* * * * *